US008516966B1

(12) United States Patent
Evans

(10) Patent No.: US 8,516,966 B1
(45) Date of Patent: Aug. 27, 2013

(54) PIVOTING MULTI-LEAF MODULAR TABLE

(76) Inventor: Paul C. Evans, Bellaire, MI (US)

( * ) Notice: Subject to any disclaimer, the term of this patent is extended or adjusted under 35 U.S.C. 154(b) by 0 days.

(21) Appl. No.: 13/487,450

(22) Filed: Jun. 4, 2012

(51) Int. Cl.
*A47B 7/00* (2006.01)

(52) U.S. Cl.
USPC ..... 108/91; 108/94

(58) Field of Classification Search
USPC ..... 108/64, 91, 92, 93, 94, 95, 139
See application file for complete search history.

(56) References Cited

U.S. PATENT DOCUMENTS 2,988,413 A * 6/1961 Bergen ..... 108/94
3,538,862 A * 11/1970 Patriarca ..... 108/94
D244,075 S * 4/1977 Imber et al. ..... D6/474
D262,169 S * 12/1981 Sonder et al. ..... D6/441
D284,339 S * 6/1986 Berry, Jr. ..... D6/484
D284,340 S * 6/1986 Berry, Jr. ..... D6/484
4,938,364 A * 7/1990 Stadelman et al. ..... 108/94
5,400,719 A * 3/1995 Santapa et al. ..... 108/64
5,666,887 A * 9/1997 Grabowski et al. ..... 108/91
5,775,233 A * 7/1998 Kendall ..... 108/94
5,810,181 A * 9/1998 Emalfarb et al. ..... 108/94
5,842,425 A * 12/1998 van der Aa ..... 108/94
6,550,402 B1 * 4/2003 Stone et al. ..... 108/94

OTHER PUBLICATIONS

Paul C. Evans, Fan Tables, drawings submitted for Design Within Reach (DWR) retail design competition, 2005-2006, 4 pages, Paul C. Evans/DWR, Chicago, U.S.
Paul C. Evans, Bloom fan table, photo of prototype submitted for Design Within Reach (DWR) retail design competition, 2005-2006, 1 page, Paul C. Evans/DWR, Chicago, U.S.
Paul C. Evans, Fan Tables, drawings submitted for Design Within Reach (DWR) retail design competition, 2005-2006, 1 page (p. 5 of 5), Paul C. Evans/DWR, Chicago, U.S.

* cited by examiner

*Primary Examiner* — Jose V Chen
(74) *Attorney, Agent, or Firm* — Traverse Legal, PLC

(57) ABSTRACT

A modular table system in which two or more tables are capable of being used independently, and are also capable of being vertically nested and rotated in the nested condition to different configurations. The tables each include a table top having a base supported by a multi-point leg or equivalent, and an inner corner supported by a tubular leg located beneath and within the periphery of the table top. The table top on at least the lower table includes an opening aligned with and matching the lower table's tubular leg to admit the upper table's tubular leg into a nested and rotating fit with the lower tubular leg.

5 Claims, 10 Drawing Sheets

PIVOTING MULTI-LEAF MODULAR TABLE

RELATED APPLICATIONS/PRIORITY BENEFIT CLAIM

Not applicable.

FIELD

The subject matter of the present application is in the field of tables, and more particularly in the field of separable tables that nest or stack.

BACKGROUND

Nesting and stacking tables are known. Modular tables that can be connected together for use as a single larger table are also known. These prior stackable or modular tables generally are not attractive, not sturdy in one or more of their modular configurations, and/or not convenient to manipulate. If made of quality materials they are often overly complex and correspondingly expensive to manufacture.

I previously invented a modular pivoting table, and entered it in a design competition at a retail store in Chicago in approximately 2005 or 2006. This table was called "Fan Tables", and consisted of three tables each having a triangular shape with rounded sides, somewhat like a guitar pick, with a base side supported by an arcuate leg or base formed from bent wire or rod. The three tables were each of different height, and pivotally connected by nesting tubular corner legs spaced from their inner corners by circular connectors projecting radially from the corners. The circular connectors in turn were connected to and spaced from the tables by contiguous extensions of the wire base legs running beneath the table tops and projecting from the inner corners. When the tubular corner legs were nested, the three tables effectively shared a single central leg spaced from the tables, with their three nested connectors forming a visible external hub about which they could pivot between a closed position (in which the three tables were vertically aligned or "nested") and an open position (in which the three tables were fanned apart in a cloverleaf structure). The table top of the upper table had an area larger than the area of the table tops on the lower tables, so that when the nested tables were rotated closed, the upper table surface covered the lower two tables. The tables could also be separated and used independently.

The central pivot legs and connector structures were complex, difficult and expensive to manufacture, and to my eyes not ideally attractive since the connecting and pivoting structures were exposed and visually distracting. The inner corners of the tables were also structurally weaker than the bases of the tables.

BRIEF SUMMARY

I have invented a nesting, pivoting, modular table system that improves on my earlier Chicago Fan Tables design with a simpler, cleaner, less expensive, more attractive, more functional, and more robust nesting/pivot connection.

The system comprises two or more tables each capable of being used independently, but also capable of being used in multiple pivot-adjusted configurations when nested. The tables of the system each comprise a generally flat table top having an outer "base" side or end, and an inner "corner". The base is supported by a multi-point leg structure or equivalent (including single wide legs or two or more separate legs) extending to the floor, and the inner corner is supported by a single inner leg extending to the floor. The inner leg supporting the inner corner extends from a lower surface of the table top, beneath the table rather than beyond the table, within the periphery of the table top. In the illustrated example, all of the inner legs are tubular legs.

The tubular leg of the second (upper) table nests vertically inside the hollow tubular leg of the first (lower) table through an opening in the lower table top adjacent the inner corner of the lower table. The upper or topmost table may or may not have an opening in the table top. The nested tables pivot via the nested tubular legs beneath the table surfaces, without any projecting or intervening connecting structure and with a pivot point defined below and within the edges of the table surfaces.

The present pivot connection produces a stronger, more stable table than my earlier design. The pivot connection is also hidden from view in both the nested and separated configurations of the tables, and throughout the entire range of adjustment of the tables when nested. The affect on the visual appearance of the tables is striking and significant in both the nested and separated configurations, as well.

The term "corner" as used herein can be applied not only to polygonal table tops with true corners, but also to table tops of any shape in which an outer or edge portion of the table top is supported by a single underlying tubular leg. This includes circular and oval table top shapes, where an outer, near-edge portion ("corner") of the circle or an end of the oval is supported by a tubular leg.

These and other features and advantages of the invention will become apparent from the detailed description below, in light of the accompanying drawings.

DETAILED DESCRIPTION

Figure 1:
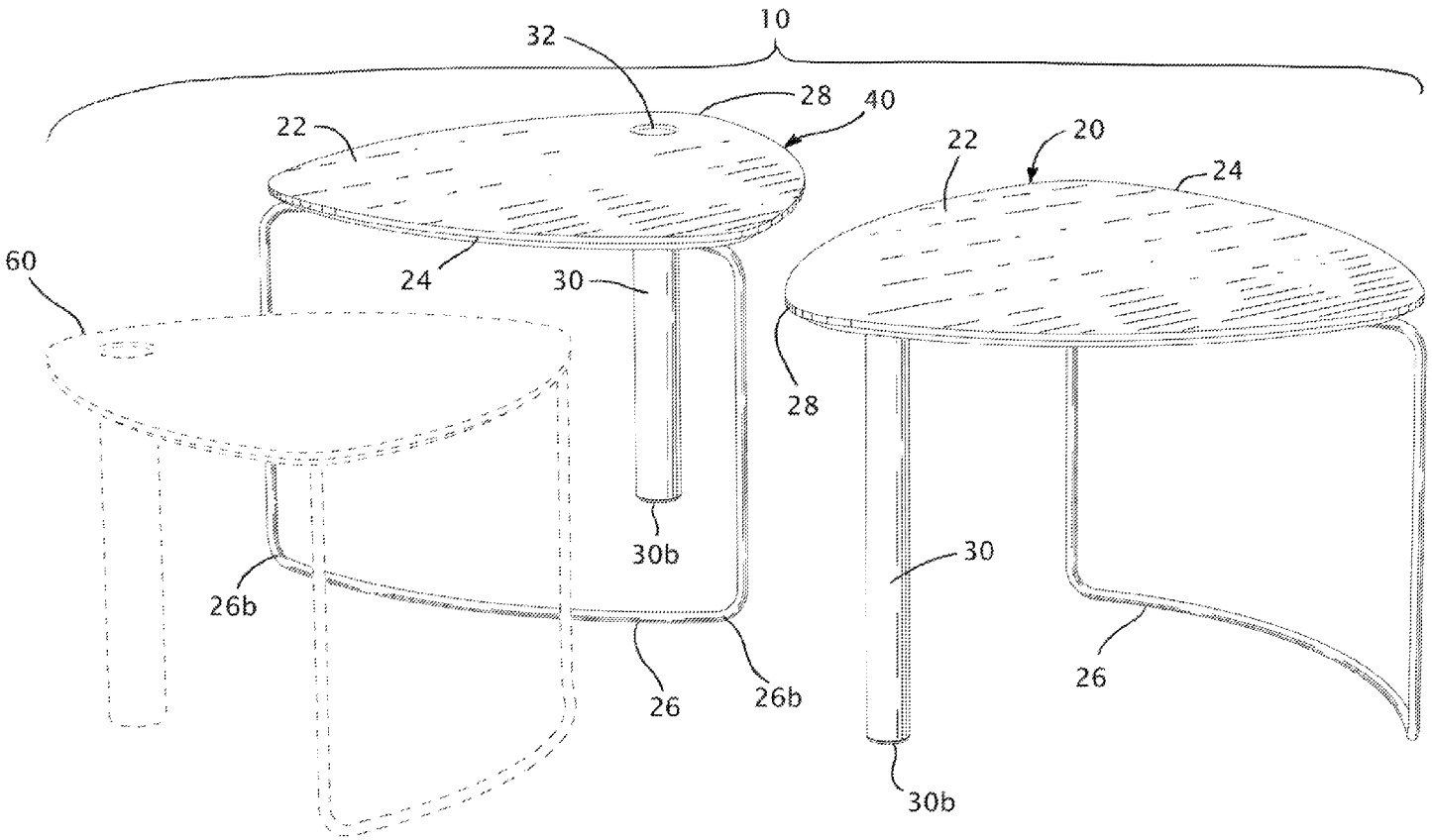
FIG. 1 is a perspective view of a system of tables according to the present invention, separated for independent use, with one table shown in phantom.

Referring first to FIG. 1, a modular nesting table system 10 is shown in exemplary form in order to teach how to make and use the claimed invention. Table system 10 includes at least two tables 20 and 40, and preferably a third table 60 as well. Each table has approximately the same shape, in the illustrated example a rounded triangle. The tables are of different height, however, with table 20 having longer legs and thus being taller than table 40, and table 40 having longer legs and thus being taller than table 60.

Referring to FIGS. 2 through 5, a single table (20) will be described in detail, since tables 20, 40, and 60 are structurally similar to one another unless noted differently. Each table has a table top 22 with a base end or side 24 supported by one or more base legs 26, and an inner corner 28 supported by a single cylindrical tubular leg 30. Each lower table also includes an opening 32 in table top 22, aligned and communicating with the hollow interior of tubular leg 30, and having a diameter equal to or greater than the diameter of the tubular leg 30 of an upper table intended to nest therein. Preferably the opening 32 will have a smaller diameter than the interior diameter of the tubular leg 30 to which the opening 32 provides access, allowing the table top material (for example, wood) to act as a bushing against the outer surface of an upper table leg inserted through it.

Base legs 26 are formed from bent wire or rod in the illustrated embodiment, with an arcuate base defining at least two spaced points 26*b* in contact with the floor, and upper ends 26*a* (FIG. 2) secured to the underside of table top 22. Although a single base leg 26 is shown supporting the base 24 of each table, it will be understood that two or more separate legs can be used to support base end 24, and that the structure and form of leg(s) 26 can vary. Base leg 26 is "multi-point" in the sense that the single continuous shape illustrated in the drawings has enough width to define at least two spaced support points at its ends 26*b*. If ends 26*b* were replaced by multiple spaced legs, their spacing should be sufficient to support the base end of the table.

Tubular (inner) legs 30 are cylindrical in the illustrated embodiment and, in at least the lower tables 40 and 60, hollow. Tubular legs 30 are formed from hollow steel or aluminum tubing in the illustrated example, although other materials are possible. Legs 30 preferably have open lower ends, and the length of the inner legs 30 on each upper table is successively longer, so that the lower end of each tubular leg in system 10 rests on the floor when the tables 20, 40 and 60 are nested. The uppermost table in system 10, however, may have a tubular leg with a closed lower end 30*b*. Legs 30 have upper ends 30*a* (FIG. 2) secured to and supporting the underside of tabletops 22.

It is possible to form some or all of tubular legs 30 with other than cylindrical cross-sections, either interior or exterior. For example, the lowermost cylindrical leg on table 60 might have a cylindrical interior diameter to accept the cylindrical tubular leg of table 40 in a rotating fit, but a non-circular exterior geometry. Another possibility would be to size the interior cylindrical diameter of a lower tubular leg 30 in the system to rotatably accept the non-cylindrical exterior of an upper tubular leg. Tubular legs 30 may also be tapered from top to bottom. Tubular legs 30 may also have variable exterior shapes or cross-sections along their lengths: e.g., a triangular section changing to a circular section, or tapered or twisted sections. "Tubular" should be understood herein to mean a shape wherein an upper leg is capable of rotatably nesting in the hollow interior of a lower leg; it may be that only the lower leg or legs in the tables of system 10 are hollow, and that an upper "tubular" leg might be solid.

The materials used for tables 20, 40 and 60 may vary, including but not limited to combinations of wood, metal, glass and/or plastic. For example, while the illustrated tables 20, 40, and 60 are shown with metal legs 24 and 30 and wood table tops 22, the legs or table tops could be formed from plastic materials. The tables may also be made from a single material—all wood, all plastic, all metal.

Figure 2:
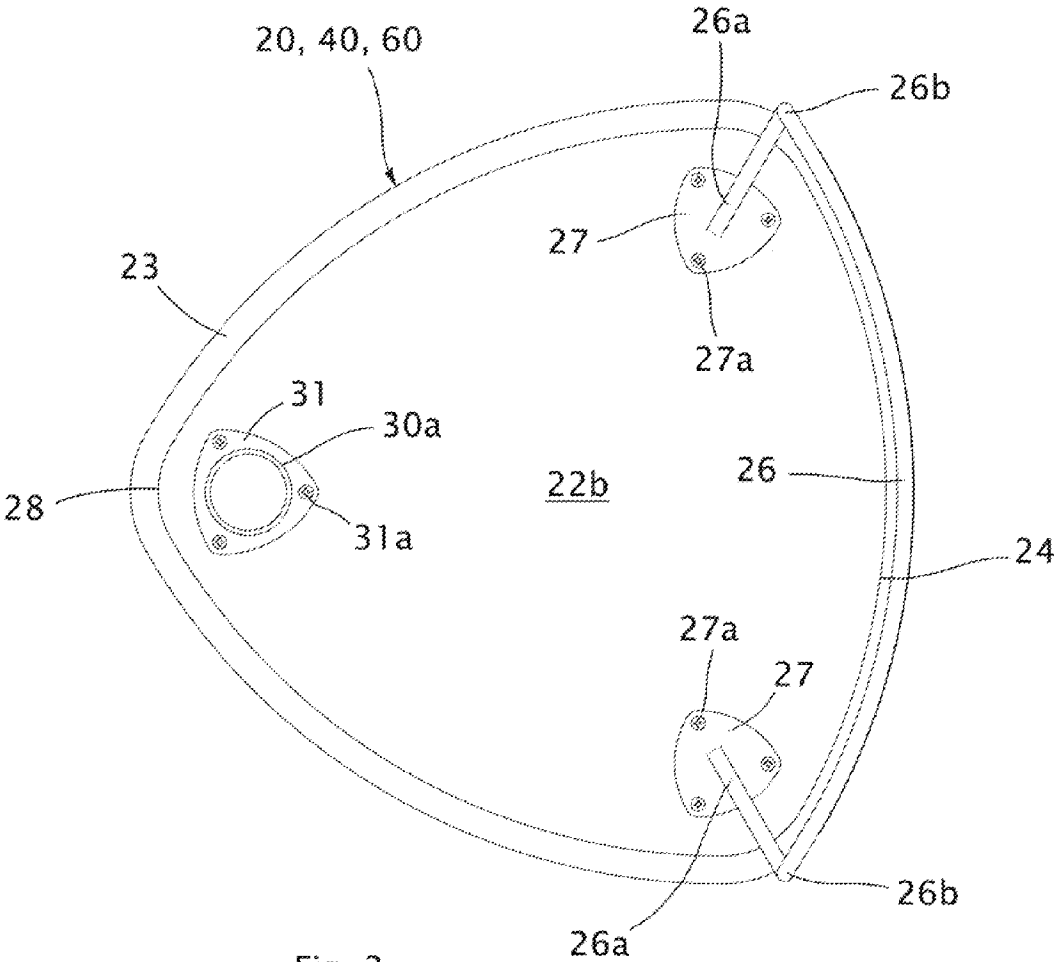
FIG. 2 is a bottom plan view of a table from FIG. 1
Figure 3:
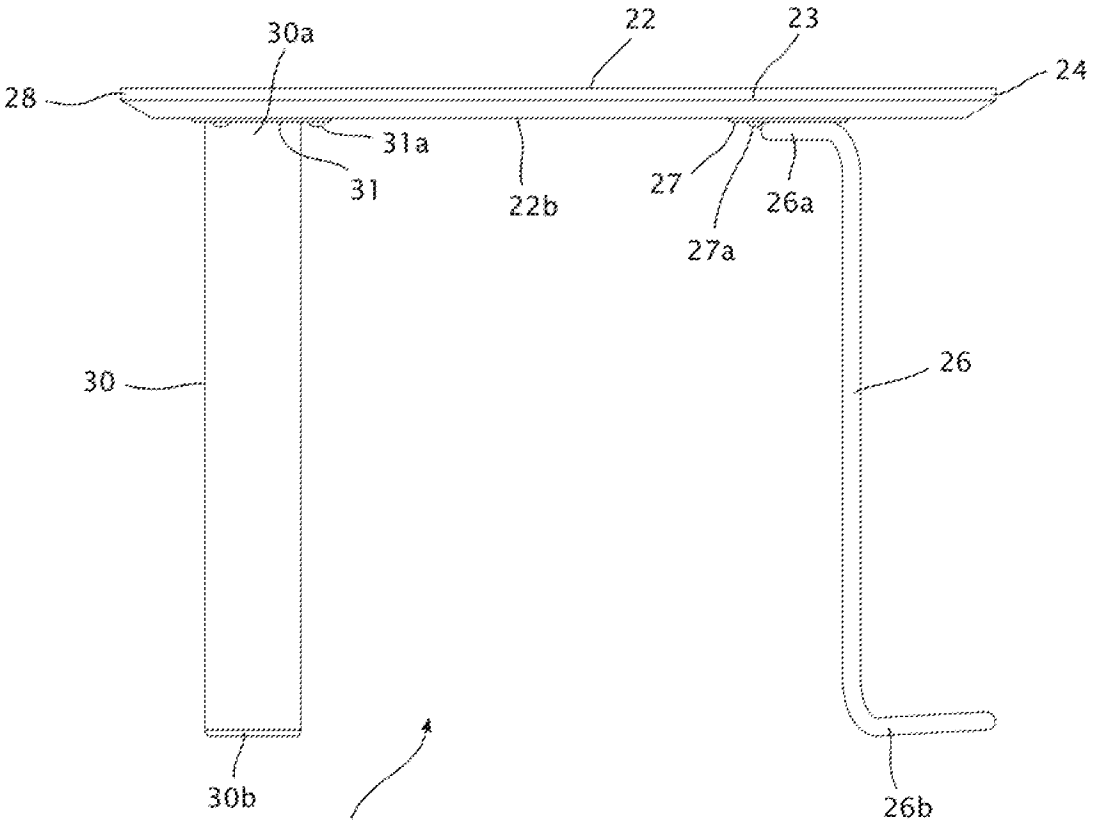
FIG. 3 is a side elevation view of a table from FIG. 1.
Figure 4:
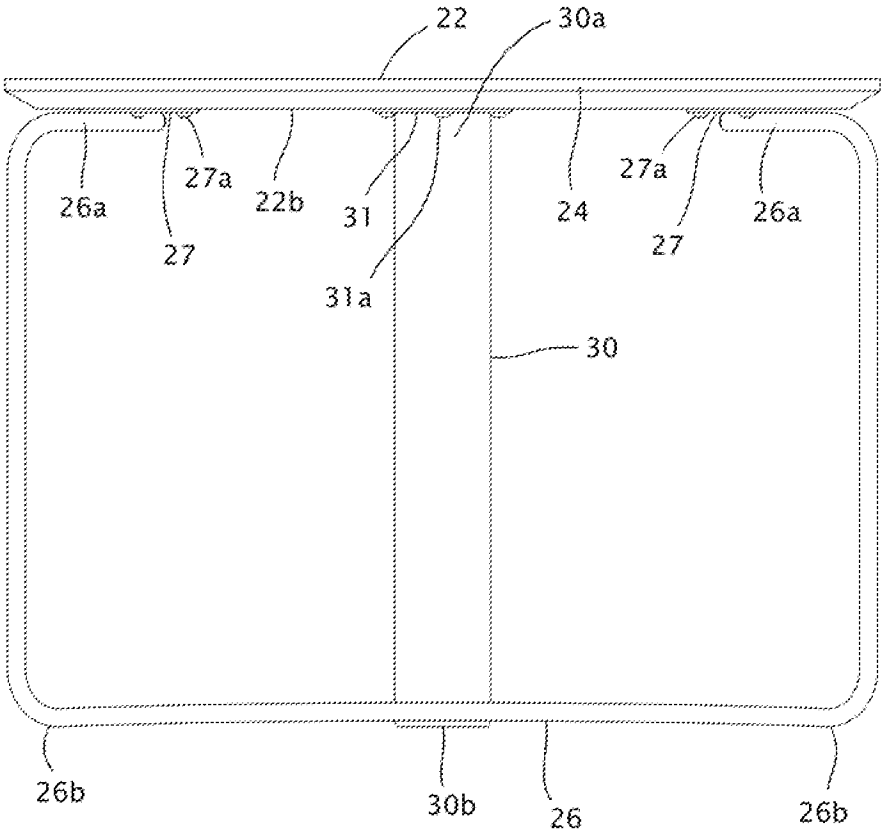
FIG. 4 is a rear (base) elevation view of a table from FIG. 1.
Figure 5:
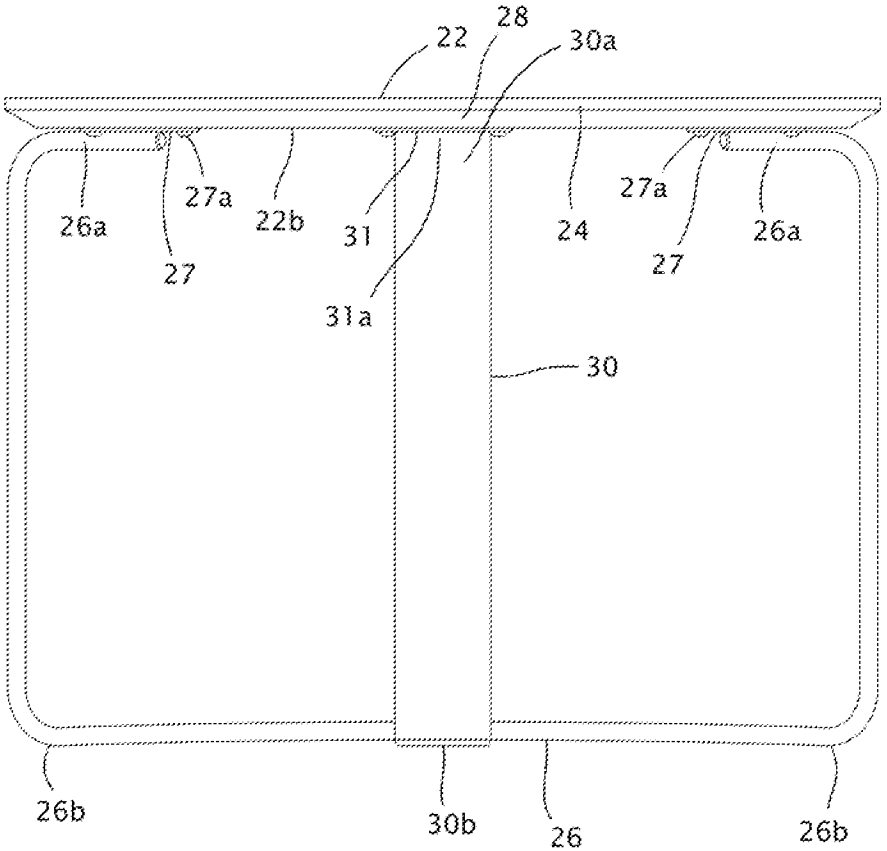
FIG. 5 is a front (corner) elevation view of a table from FIG. 1.

Referring to FIG. 2, the connections of base leg 26 and tubular leg 30 to the underside of each table are illustrated. The terminal ends 26*a* of base leg 26 are connected to or include flanges 27, which may be secured to the underside 22*b* of table top 22 with fasteners such as screws 27*a*. The upper end 30*a* of leg 30 is similarly connected to (or includes) a flange 31 secured with fasteners 31*a*. These flange connections are currently preferred, but are not limiting, since the ends of legs 26 and 30 can be connected to the table top directly, or via other forms of connection, and/or may be integrally formed or molded with table top 22. Depending on the thickness of table top 22, the connection of leg 30 to the table might not be directly to the underside of the table, but via an intervening structure such as a flange or collar, or within opening 32, without limitation, provided that the leg 30 and any connecting structure does not extend beyond the edge of the table. "Underside" should be construed accordingly.

FIG. 2 best shows the interior location of tubular leg 30 adjacent inner corner 28. Tubular leg 30 is located beneath table top 22, and within the periphery or side edge(s) 23 of the table top, so that its connection to the table is hidden from view when the table is upright.

While tables 20, 40 and 60 are shown as having a substantially identical shape, they may have different shapes provided they maintain a base with a multi-point (two or more points or equivalent) leg support and an inner corner with a single tubular leg.

The dimensions and proportions of the tables 20, 40 and 60 may vary, and are not limited to those illustrated.

Description of Use

FIGS. 1 through 5 show the tables of system 10 in use as independent, standalone tables. FIGS. 6 through 10 show the operation of table system 10 when tables 20, 40 and 60 are nested via their tubular legs 30.

Figure 6:
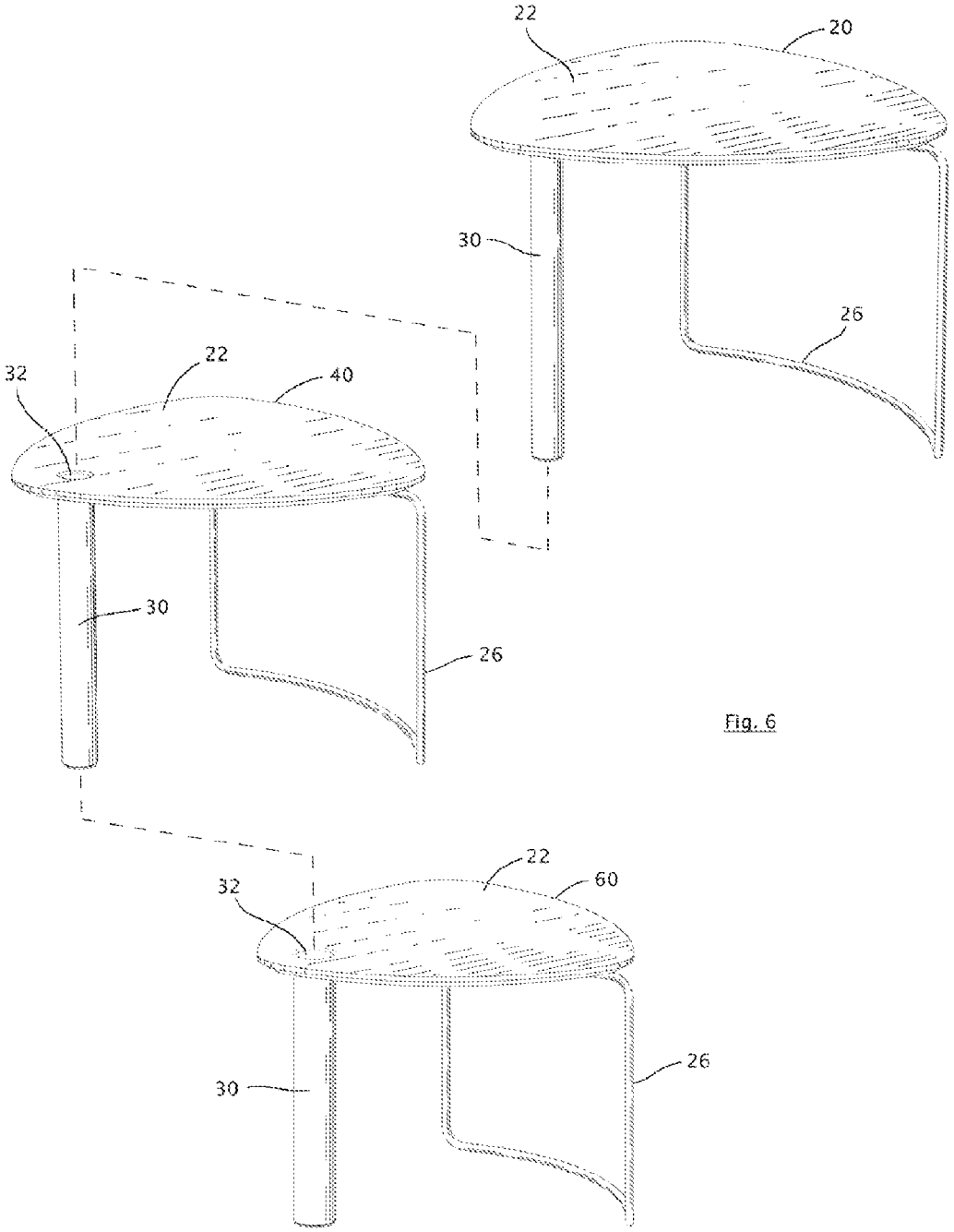
FIG. 6 is an exploded assembly view of the three tables of FIG. 1.

In FIG. 6, table 40 is nested or stacked on top of table 60 by inserting tubular leg 30 on table 40 through opening 32 in the table top of table 60 and into the hollow interior of tubular leg 30 in table 60. Table 20 is nested or stacked on top of tables 40 and 60 by inserting its tubular leg 30 through the opening 32 in table 40 and into the hollow interior of tubular leg 30 in table 40. The result is a nested configuration with all three tables joined via their nested tubular legs 30 directly through the table tops 22 of the two lower tables.

Figure 7:
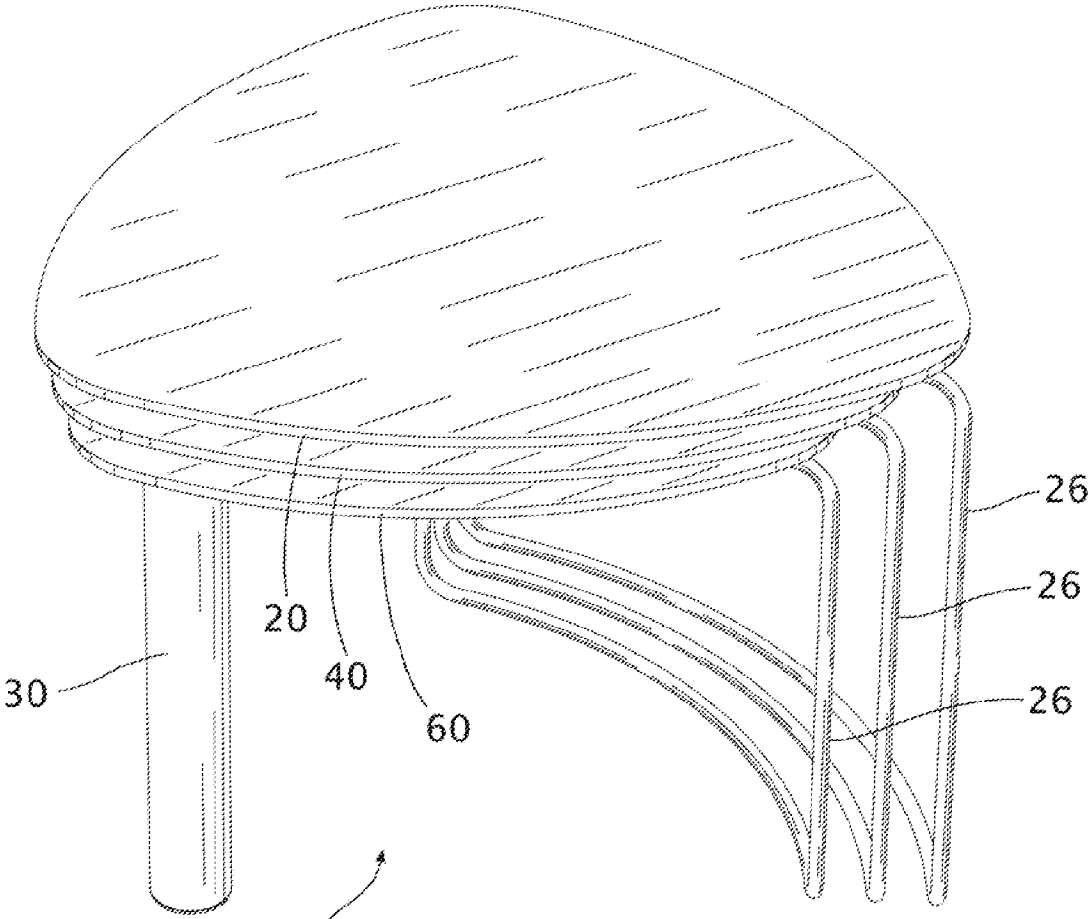
FIG. 7 is a perspective view of the tables of FIG. 1, assembled and rotated to a closed (nested) position.
Figure 8:
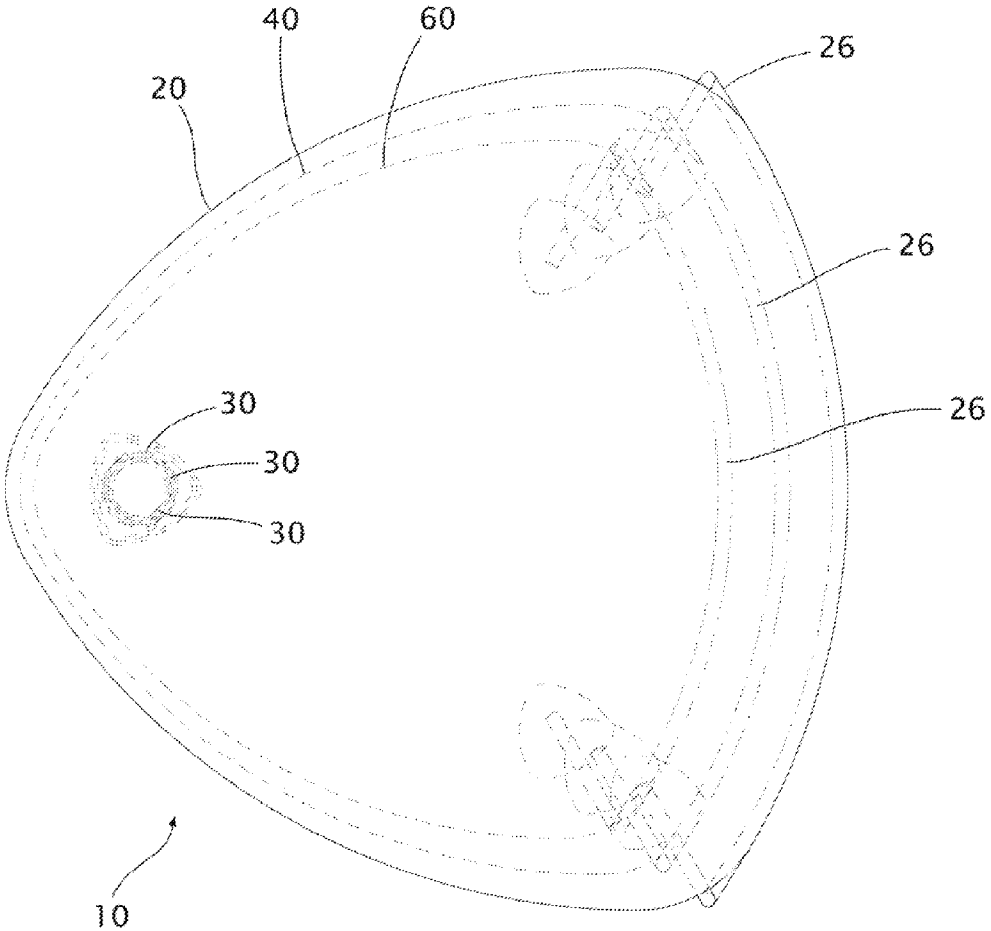
FIG. 8 is a top plan view of the tables in the closed position of FIG. 6.

Referring to FIGS. 7 and 8, the tables nested via the procedure in FIG. 6 are shown in their closed configuration, with all three tables rotationally aligned so that upper table 20 overlies both of the lower tables 40 and 60. The radial dimensions of the upper tables' table tops 22 and base legs 26 are successively larger than those of the lower tables', so that the table tops 22 of the upper tables overlie the table tops of the lower tables, and so that the base legs 26 of the upper tables lie outwardly of the base legs of lower tables. The height of the base legs on all three tables is different, in order to allow them to provide even support when the tables are rotated open. The outer diameters of the upper tables' tubular legs 30 are less than or equal to the interior diameters of the lower tables' tubular legs 30 so that they nest. "Diameter" should be understood to include dimensions of width, for example where one or more legs 30 is not cylindrical. Also, the diameter/width of the lower legs' hollow interiors need not be constant, as long as they are able to receive and allow rotation of the upper legs' maximum effective diameter/width.

In the closed configuration of FIG. 7, tables 20, 40, and 60 effectively function as a single table 20, maximizing space efficiency.

Figure 9:
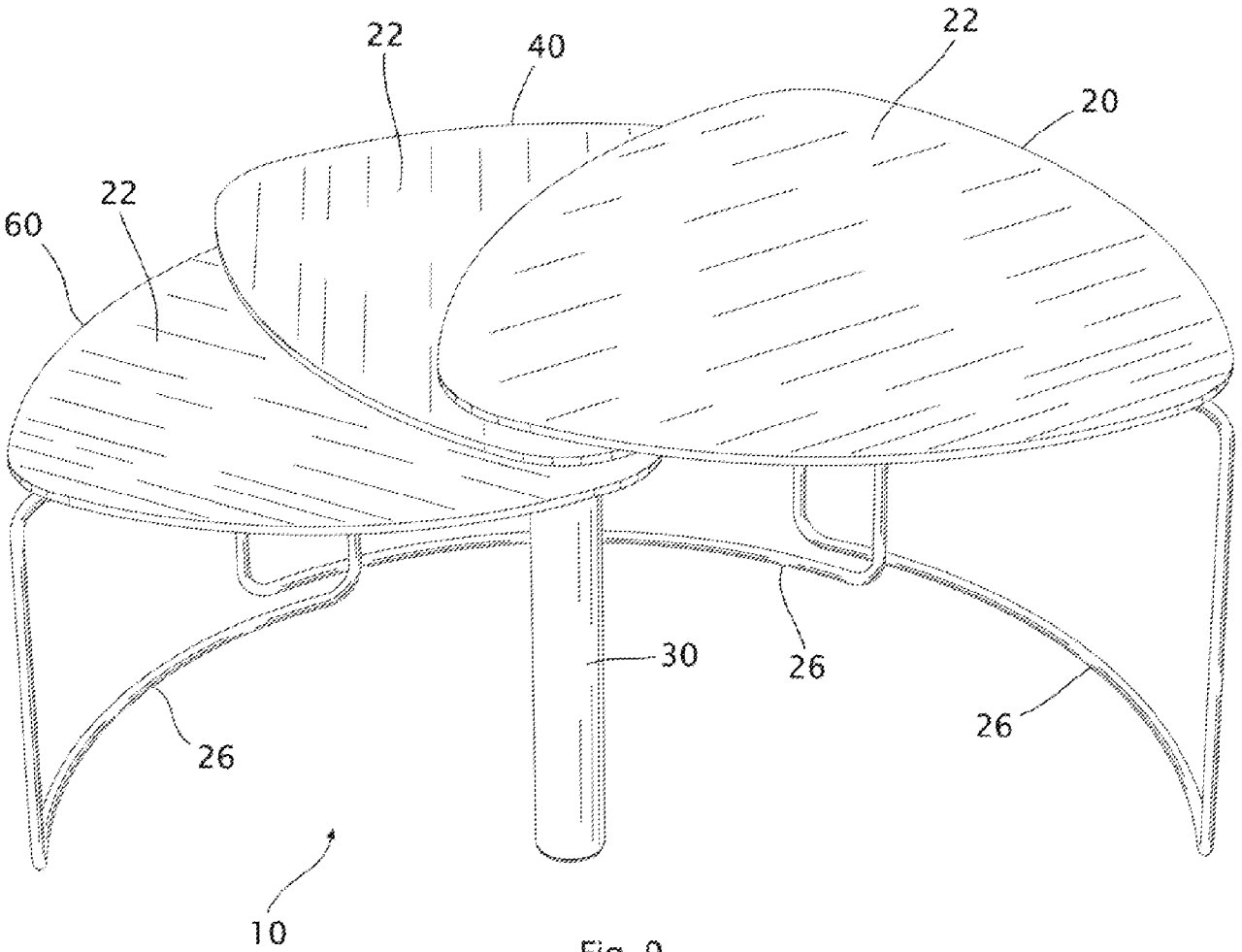
FIG. 9 is a perspective view of the tables of FIG. 1, assembled and rotated to a partially open position.

In FIG. 9, the three nested tables 20, 40 and 60 have been rotated to a partially open configuration in which all of table top 22 is exposed and useable, while portions of the table tops 22 of lower tables 40 and 60 are exposed and useable. It will be appreciated that the table tops 22 are at different heights.

Figure 10:
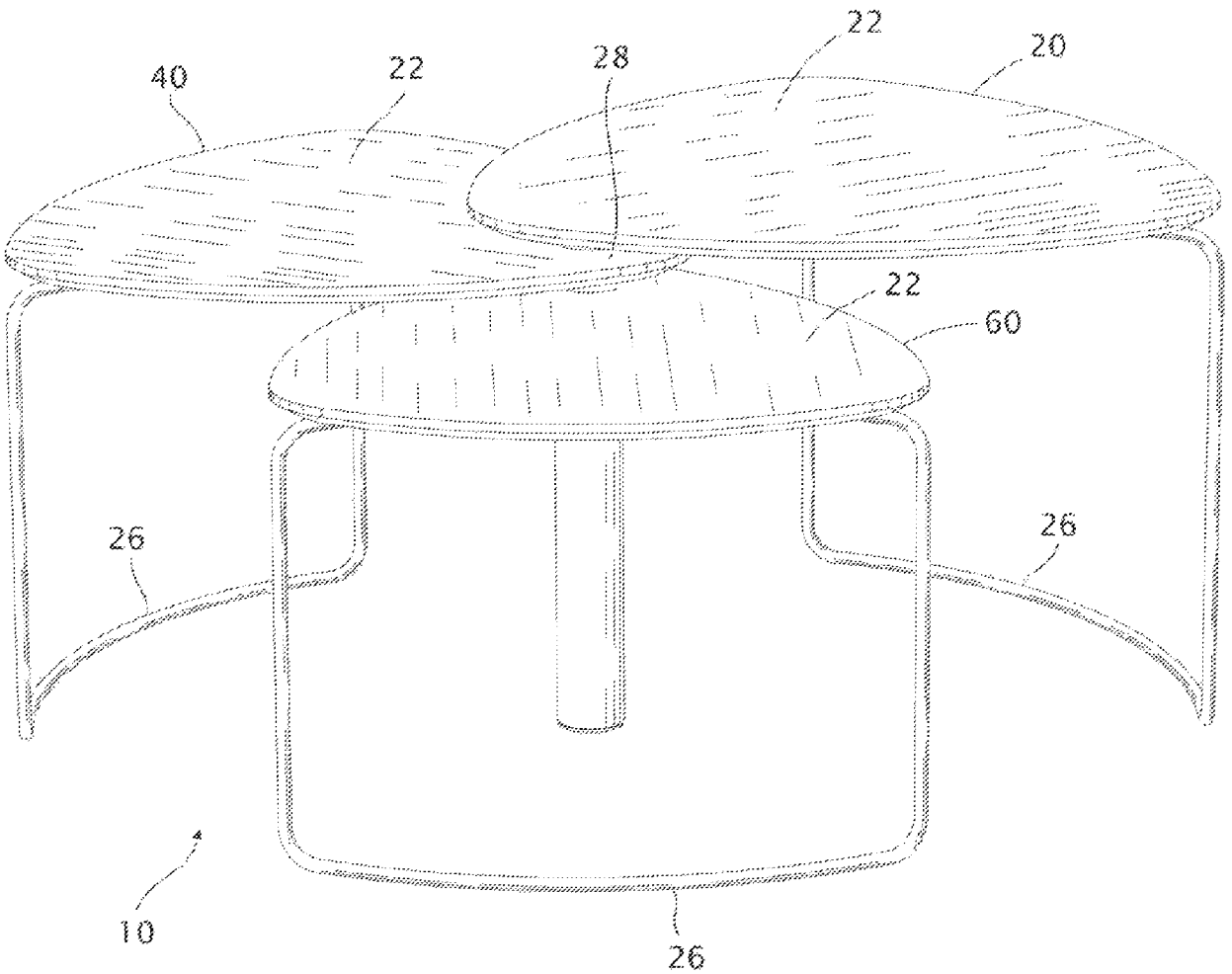
FIG. 10 is a perspective view of the three tables of FIG. 1, assembled and rotated to a fully open position.

In FIG. 10, the three nested tables 20, 40 and 60 have been rotated to a fully open configuration in which most or all of the tables' table tops 22 are exposed and useable, with the exception of portions of the inner corners 28 of the two lower tables 40 and 60.

It should be understood that while three tables of substantially identical form are shown in the illustrated example, the tables may have differently-shaped table tops or base legs, provided they are still able to nest and rotate via the tubular legs 30. Also, the different tables 20, 40 and 60 in a set comprising system 10 could be made from different materials—for example, one with a wood top, one with a metal top, and one with a glass top.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention should accordingly be construed by what the above disclosure teaches and suggests to those skilled in the art, and by any claims that the above disclosure supports in this application or in any other application claiming priority to this application.

What is claimed is:

1. A modular nesting table system comprising:

an upper and a lower table, each table comprising a table top including a periphery defined by one or more side edges, a base end associated with a first portion of the periphery on a first side of the table top, and an inner corner associated with a second portion of the periphery on a second side of the table top generally opposite the first side of the table top, the base end including multipoint support leg means extending downwardly to the floor from an underside of the table top to support the base end above the floor upon two or more spaced points in contact with the floor, and the inner corner including an inner leg extending downwardly to the floor from an underside of the table top within the table top periphery to support the inner corner above the floor, and further wherein the inner leg in the lower table is tubular with an open upper end and is sized to receive the inner leg on the upper table in a nested rotating fit; and, the lower table including an opening in the table top associated with the inner corner, the opening aligned and communicating with the open upper end of the tubular leg in the lower table, the opening having a width or diameter equal to or greater than the width or diameter of the inner leg on the upper table to admit the inner leg on the upper table through the lower table top into the lower tubular leg; and, the tubular leg on the lower table having an internal width or diameter sufficient to receive the inner leg on the upper table in a nested rotating fit.

2. The system of claim 1, wherein the inner leg on the upper table is tubular.

3. The system of claim 1, wherein the opening in the lower table top has a width or diameter less than the internal width or diameter of the tubular leg on the lower table, such that an outer surface of the inner leg on the upper table is spaced from contact with an interior surface of the tubular leg on the lower table if the inner leg on the upper table is inserted through the opening into the tubular leg on the lower table.

4. The system of claim 1, wherein the tubular leg on the lower table has an open lower end, and wherein a lower end of the inner leg on the upper table contacts is capable of contacting the floor through the open lower end of the tubular leg on the lower table if the tables are nested.

5. The system of claim 1, wherein the upper and lower tables each comprise a table top whose periphery defines a rounded triangular shape, and whose base end corresponds to first and second corners of the triangular shape and whose inner corner corresponds to a third corner of the triangular shape.

* * * * *